United States Patent [19]

Grimm

[11] Patent Number: 4,500,213

[45] Date of Patent: Feb. 19, 1985

[54] ULTRA-FLAT SELF-WINDING WATCH

[75] Inventor: Maurice Grimm, Neuchatel, Switzerland

[73] Assignee: Ebauches, S.A., Switzerland

[21] Appl. No.: 312,731

[22] Filed: Oct. 19, 1981

[30] Foreign Application Priority Data

Oct. 24, 1980 [CH] Switzerland ..... 7961/80

[51] Int. Cl.[3] ..... G04B 5/02

[52] U.S. Cl. ..... 368/208; 368/207

[58] Field of Search ..... 368/208, 207

[56] References Cited

U.S. PATENT DOCUMENTS

| | | | |
|---|---|---|---|
| 2,028,594 | 1/1936 | Feigel | 368/148 X |
| 2,029,559 | 2/1936 | Colomb | 368/148 |
| 2,981,055 | 4/1961 | Froidevaux et al. | 368/208 |
| 3,067,571 | 12/1962 | Gigandet | 368/208 |
| 3,412,550 | 11/1968 | Delessert et al. | 368/208 |

*Primary Examiner*—Bernard Roskoski

*Attorney, Agent, or Firm*—Allegretti, Newitt, Witcoff & McAndrews, Ltd.

[57] ABSTRACT

The watch has a winding weight comprising an arm 10*a* and an oscillating mass 10*b*. The arm is mounted for pivotal movement about the axis of a toothed ring 12 by way of which the spring barrel 20 is kept wound and which axis is offset with respect to the watch hand axis X, X'. The oscillating mass 10*a* is at the same level relative to the case back 6 as the spring barrel 20. The length L' of the winding weight is greater than the offset L and more than half the largest dimension of the case 6. The oscillating mass 10*b* thus occupies substantially half the casing of the watch and is almost as thick as the distance between the glass and the back 6 which is also the rear plate of the movement.

7 Claims, 7 Drawing Figures

ULTRA-FLAT SELF-WINDING WATCH

BACKGROUND OF THE INVENTION

The present invention relates to a self-winding watch, particularly, but not exclusively, a watch of the extra thin type, that is to say a watch in which the distance between the back of the case and the glass is as small as possible.

Self-winding watches have been known for a long time. They differ from ordinary mechanical watches in that they comprise a winding weight mounted for oscillating movement about a pivotal axis which is perpendicular to the back of the watch and a gear train which transmits the energy produced by the oscillation of the winding weight of the spring barrel.

For example, Swiss Pat. Nos. 610,178 and 198,991 describe such watches. In these two cases, the watch comprises a plate carrying the usual parts of the movement of an ordinary mechanical watch and, beneath this plate, the winding weight. In the case of Swiss Pat. No. 610178, the winding weight is mounted for pivotal movement on a pivot pin rigid with a winding plate. In the case of Swiss Pat. No. 198,991, the pivotal axis of the winding weight is mounted between the supporting plate of the movement and the back of the case. In these two cases, the winding weight oscillates around an axis which coincides with the axis of watch hands. It is therefore superimposed on the ordinary movement of the watch and in its pivotal movement, the winding weight occupies a whole sector of the interior volume of the watch case. This obviously results in a substantial increase in the thickness of the automatic watch as compared with the thickness that an ordinary watch of the same type would have. It likewise is known to juxtapose the movement and the winding weight in a common plane. However, the winding energy is then weak and the dimensions of the watch, as seen in plan, are considerably increased.

Now, it is clear that the present tendency in the horological industry is to produce relatively flat, thin watches. In fact, considerable efforts have been made during the last few years by designers to reduce the thickness of watches, whether they be electronic watches or mechanical watches. Moreover, it is equally clear that the considerable development of electronic watches has caused the user to become accustomed to not having to wind his watch every day. Hence the interest is making very thin self-winding mechanical watches.

BRIEF SUMMARY OF THE INVENTION

The present invention has specifically the object of providing a self-winding watch which is of small thickness, e.g., having a thickness of less than 2 mm, while as seen in plan view, it remains within reasonable dimensions.

Another object of the invention is to provide a self-winding watch, the winding weight of which can store a sufficient amount of energy during normal use of this watch.

Another object of the invention is to provide a self-winding watch, whose external appearance is not altered by its reduced thickness.

According to the present invention, there is provided a self-winding watch comprising, within a case with a back, analogue time-indicating means rotating about a first axis perpendicular to the back, a winding weight oscillating about a pivotal axis parallel to the watch hand axis and comprising an oscillating mass and an arm, a spring barrel receiving the energy produced by the movement of the winding weight, an escapement-balance wheel unit and a train of moving parts drivably interconnecting the spring barrel, the time-indicating means and the escapement-balance wheel unit, the pivotal axis of the winding weight being offset with respect to the first axis, the minimum distance from the pivotal axis from a point on the winding weight being greater than the said offset and the winding weight as a whole being located at the same level relative to the back as the spring barrel.

The said maximum distance is preferably greater than half the largest dimension of the case. Thus, the superimposition of the most bulky parts is replaced by a later separation of these parts. For example, the wheels located on the watch hand axis are offset with respect to the bearing of the winding weight and to an associated wheel located on its pivotal axis. Likewise, there is no more overlapping between the winding weight and the bulky parts such as the spring barrel. The thickness of the watch can therefore be substantially reduced. Finally, due to the fact that the winding weight extends to the side of the watch hand axis remote from the pivotal axis, the moment of inertia of the winding weight is increased, while at the same time the plan area of the watch is kept within reasonable limits.

Due to the fact that the winding weight is constituted by an oscillating mass fixed to the end of an arm which is mounted for pivotal movement about the pivotal axis, thus, the oscillating mass can occupy one part of the casing of the watch, while the other bulky parts, such as the spring barrel and the escapement mechanism, are arranged within a second part of the watch casing. The reduction in the range of movement of the oscillating mass is compensated for by the increase in the moment of inertia. Moreover, the oscillating mass is preferably located wholly on one side of the longitudinal axis of the arm. Thus, only the arm is present in the vicinity of the axis of the watch hands. It thus is easy to give it a special shape such that, throughout the whole of its range of movement, it is completely clear of the whole of the space occupied by the axes of the watch hands and associated wheel.

Finally, in order to reduce the thickness of the casing of the watch still further, the back of the case serves as the mounting plate for the gear trains and other mechanisms, and the analogue time-indicating means are set back into the case of the watch in which they occupy a central region. The thickest part of the oscillating mass as well as the spring barrel and the escapement mechanism, are accomodated in a peripheral region outside this central region.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

The description which follows is concerned with the case in which the indication of time is obtained by means of two hands, namely an hour hand and a minute hand. However, it is well known that the indication of time can be effected by means of two superimposed disks bearing respectively an index of hours and an index of minutes. These disks are rotationally driven at their periphery by means of a peripheral set of teeth which meshes with wheels which are themselves driven by the spring barrel. The invention could equally well be applied to this analogue method of indication by means of modifications within the competence of the man skilled in the art, having regard to the teaching of the present specification.

Figure 1A:
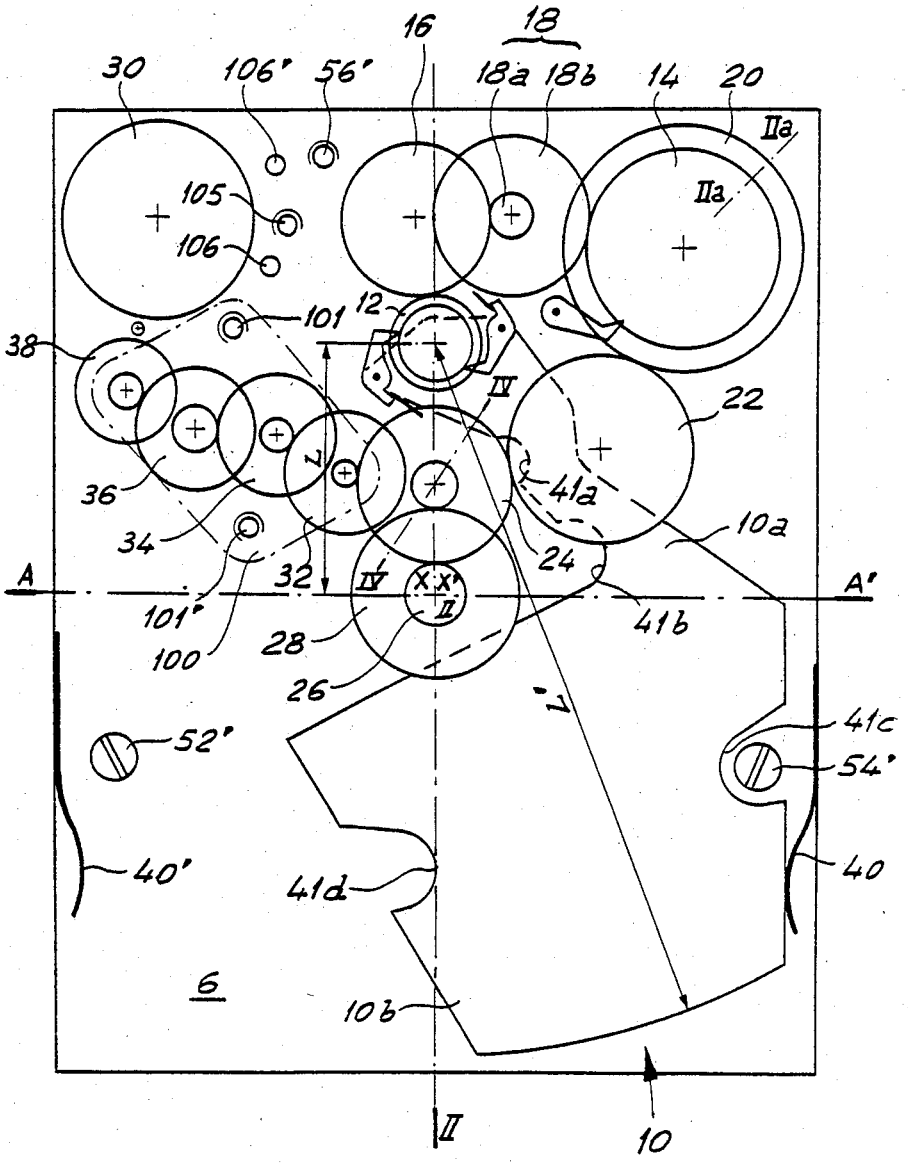
FIGS. 1*a* and 1*b* are simplified top plan views of a watch embodying the invention, illustratively, showing in particular the way in which the winding weight is incorporated in the case, FIG. 1*a* showing the movement with the dial and the upper bridge plates removed and FIG. 1*b* showing the watch with its glass and the upper bridge plates.
Figure 1B:
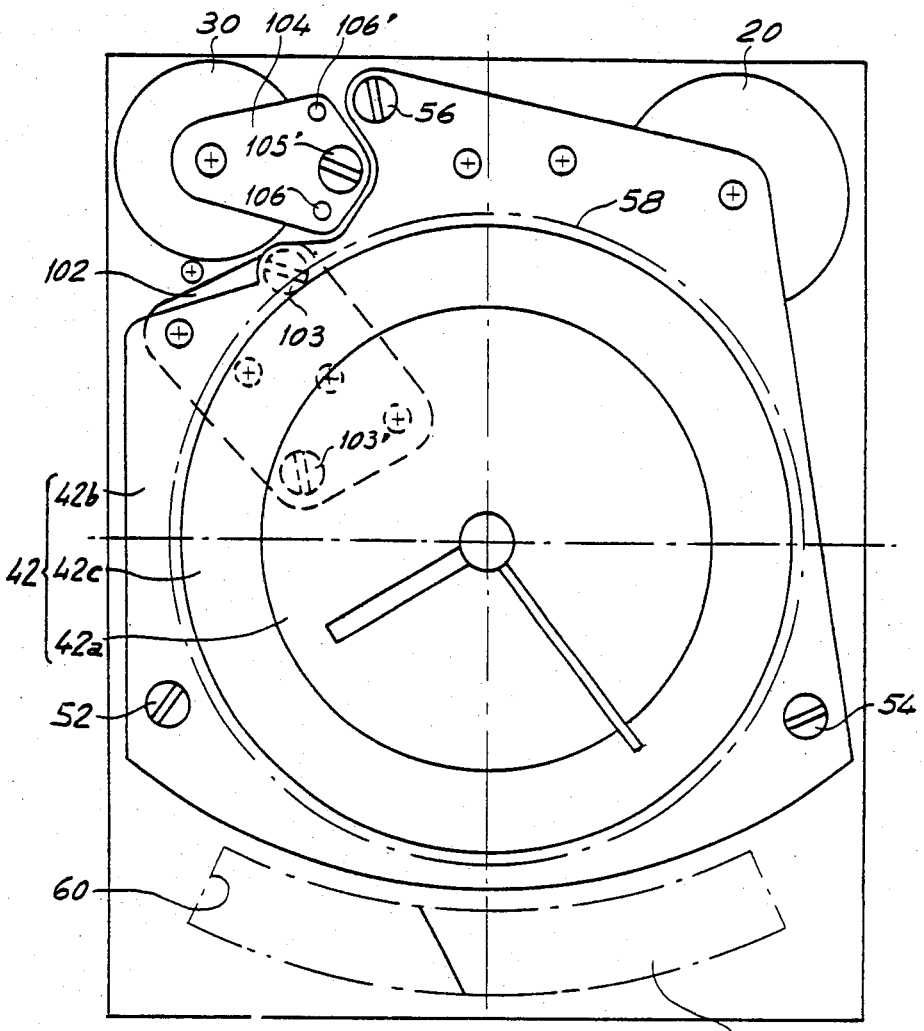
Figure 2:
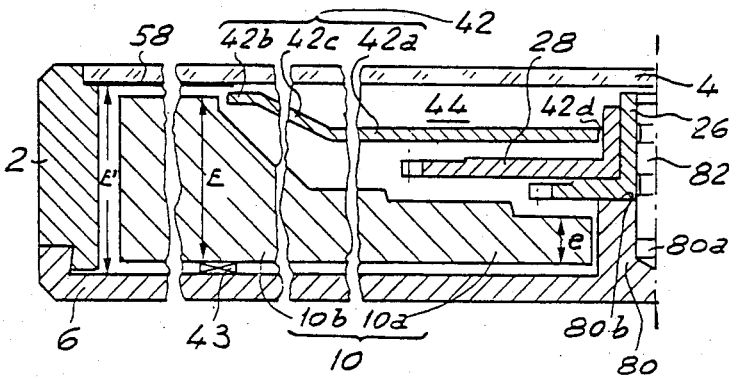
FIGS. 2*a*, 2*b* is a section on the line II—II of FIG. 1*a* of half of the watch, the oscillating mass being in its upper position, showing the way in which the oscillating mass of the winding weight occupies the entire thickness of the watch within a certain region of the case.
Figure 2A:
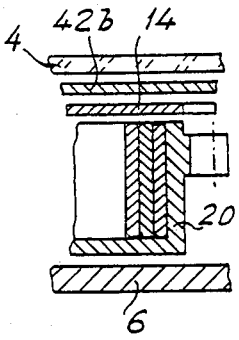

FIGS. 1 and 2 show the general arrangement of the watch as seen from above (FIGS. 1*a* and 1*b*) and in vertical section (FIG. 2) so as to show the layout of the component parts in the direction of the thickness of the watch.

The case of the watch is comprised of a thick rim piece 2 fitted with a watch glass 4 which extends over the entire front of the case, and is closed by a back part 6. The case thus defines an interior space which is delimited by a back plate (the back 6), a front plate (the glass 4 and part of the rim piece 2) and a lateral wall (part of the rim piece 2). In the case considered, the front and rear plates are substantially flat and parallel, thus defining the plan of the watch.

Considering the watch in plan only, it comprises a winding weight 10 mounted for pivotal movement about a pivotal axis Y, Y′ (FIGS. 3*a*, 3*b*) which is perpendicular to the plane of the watch. The oscillation of the winding weight is transmitted to a toothed ring 12 via a double pawl system which is explained below. The rotation of the ring 12 is transmitted to a ratchet wheel 14 by wheels 16 and 18 of a winding gear train, the wheel 18 comprising a pinion 18*a* and a gear wheel 18*b*. The spring barrel 20 is drivably connected by a wheel 22 to a wheel 24 which in turn is in mesh with a minutes center wheel 26 and an hour cannon wheel 28 which carry the minute hand and the hour hand respectively. These two wheels define a watch hand axis X—X″ which, in this case, coincides with the geometrical axis around which the time-indicating means turn. In the case where the indication is by means of hands, it corresponds to the geometrical axis of the cannon wheel and the center wheel. In the case of time-indicating disks, it corresponds to the geometrical axis extending through the centers of the disks. It is well known that, in certain constructional forms of indication of disk, this watch hand axis is not constituted by any mechanical part. This watch 24 is drivably connected to an escapement-balance wheel unit 33, 30 by a final gear train constituted by wheels 32, 34 and 36, each comprising a gear wheel and a pinion.

Examination of FIGS. 1 and 2 clearly reveals the originality of the invention. First of all, the axes X, X′ and Y, Y′ are not aligned with each other. The pivotal axis Y, Y′ is offset with respect to the watch hand axis X, X′ by a distance L and the winding weight occupies substantially the same thickness as the spring barrel, i.e., as the most bulky element. Moreover, the maximum distance L′ separating the pivotal axis Y, Y′ from that point on the winding weight which is farthest from this axis is greater than the offset distance L. More specifically, the maximum length dimension L′ of the winding weight is more than half the maximum dimension of the case. In the particular example described, this last-mentioned maximum dimension is the diagonal of the case. In other cases, it could be the diameter of the case.

Furthermore, the winding weight 10 comprises on the one hand an arm 10*a* and on the other hand an oscillating mass 10*b*. The oscillating mass 10*b* is fixed to one end of the arm 10*a* while the other end of this arm is mounted for pivotal movement about the pivot axis Y, Y′. The arm 10*a* has a very small width, as compared with that of the oscillating mass 10*b*, in the plane of the watch. In addition, almost the whole of the oscillating mass 10*b* is located on one and the same side of the longitudinal axis of the arm 10*a* of the winding weight 10. As is well known, the winding weight oscillates about the axis X—X′ under the action of the movements imparted to the watch as a whole. The extent of movement of the oscillating mass 10*b* is limited by two springs 40 and 40′ fixed to the outer wall of the case. These springs are, for example leaf springs. On the one hand these springs serve for preventing shock due to impact between the oscillating mass and the case and, on the other hand, they restored to the oscillating mass part of the energy that has been stored in them during the impact by the winding weight 10. In the illustrated embodiment, the extent of angular movement of the oscillating mass is around 30°.

In addition, it is very important to note the distribution of the various different parts in the plane of the watch in relation to the median plane A—A′ of FIG. 1*a*. The zone below the plane A—A′ in relation with said median plane contains only the oscillating mass 10*b* and obviously also one "half" of the time-indicating wheels (i.e. half of the center wheel and half of the hour cannon wheel). It thus is possible to make the oscillating mass of substantial thickness. The zone above the plane A—A′ contains the bulky mechanisms, i.e., the spring barrel 20 and the escapement mechanism 30. This zone also contains the whole of the gear train and finally the pivotal axis Y—Y′ of the winding weight 10.

It also appears clearly that the reduction of energy, which results from the fact that the oscillating mass corresponds to only a fraction of the surface area of the watch movement, is partly compensated for by the increased moment of inertia given by the spacing of most of the mass of the weight from its pivotal axis Y—Y′. This in turn results from the eccentricity of the pivotal axis Y—Y′ of the winding weight and the elongation of the latter. The reduction of energy also is compensated for by the fact that the oscillating weight is of substantially increased thickness. This results from the positioning of the spring barrel, the escapement system and the gear trains in the upper region of FIG. 1. Moreover, the oscillating mass is preferably composed of a very high density alloy, such as a platinum-iridium alloy. In addition, the presence of the arm 10*a* and the fact that the oscillating mass 10*b* is located entirely on one and the same side of the longitudinal axis of the arm, to the left thereof in FIG. 1*a*, enables the winding weight 10 to avoid the gear wheels 24, 26 and 28, while at the same time being given a sufficiently large extent of angular movement, for example about 30°. Furthermore, the arm 10*a* and the oscillating mass 10*b* are provided with recesses 41*a*, 41*b* and 41*d* in order to avoid various different parts of the watch movement. Moreover, the driving connection between the spring barrel 20 and the wheels 24 which drives the hand-carrying wheels is provided by a moving part 22 consisting of only one wheel of relatively large diameter. Since there is only one wheel, with no pinion, it occupies only a reduced thickness. It is thus possible to leave sufficient room between the axes of the wheels 22 and 24 to provide the desired clearance for the arm. Guide rollers, such as 43 (FIG. 2), may be provided on the lower surface of the oscillating mass 10*b*. More precisely the area of the back plate which is swept by the arm 10*a* is free from axis of wheels. This area is limited by the axis of the wheels 22 and 24, 26 and 28. Moreover, since the oscillating mass 10*b* is located on one and the same side of the longitudinal axis of the arm 10*a*, the amplitude of the oscillations of the oscillating mass is substantially equal to the "width" of the watch casing. However, the arm of the winding weight does not overlap the axis XX of watch hand axis.

Referring more particularly to FIG. 2, it can be seen that the watch is of a special construction which enables its thickness to be still further reduced. Indeed, on the one hand, the base 6 of the case serves as a mounting plate for the watch movement and, on the other hand, the dial 42 of the watch has the form of a dish and is sunk into the movement. The dial has a flat circular part 42*a* which forms the dial proper. This circular part 42*a* is connected to an external part 42*b*, which is likewise flat, by means of a frusto-conical part 42*c*. The circular and frusto-conical parts define with the watch glass 4 a display zone 44 within which the hands are arranged, as is explained below. FIG. 2 shows that the arm 10*a* has a reduced thickness e to enable it to pass beneath the dial 42 and beneath the wheels 24, 26 and 28 which are located in the center of the watch and a maximum thickness E outside the frusto-conical parts 42*e* of the dial 42. In the external region where the oscillating mass has a thickness equal to E, the oscillating mass occupies substantially the whole of the thickness E' of the watch between the glass 4 and the back plate 6.

It must, however, be remarked that the characteristics of the winding weight 10 would be fully applicable to the case of a mechanical watch having a conventional movement mounted between two plates and independently of the case. Indeed, in such a case, the characteristics previously specified are always indispensable in order to save space. Moving parts in the center of the watch should still be avoided and it would always be useful therefore to displace the pivotal axis of the winding weight. For the same reasons, it will be indispensible to position the spring barrel and the escapement mechanism near the periphery and to locate the wheels of the final gear train outside the region traversed by the arm of the winding weight.

Moreover, in this embodiment, the dial 42 is fixed to the back plate 6 by means of three screws 52, 54 and 56 which extend through the external part 42*b* and are screwed into footings 52', 54' and 56' which are rigid with the bottom part 6. For aesthetic reasons, it may be advantageous to provide a metallic coating 58 on the portion of the glass 4 which borders the frusto-conical part 42*c* of the dial 42. The inner edge of this metallic coating is indicated by a chain-dotted line in FIG. 1*b*. It is thus possible to conceal the external portion 42*b* of the dial and the members that are not covered by the dial. Nevertheless, a window 60 having no metal coating could be arranged above the thick part 10*b* of the oscillating mass so as to enable the latter to be seen when the watch is in operation.

Figure 3A:
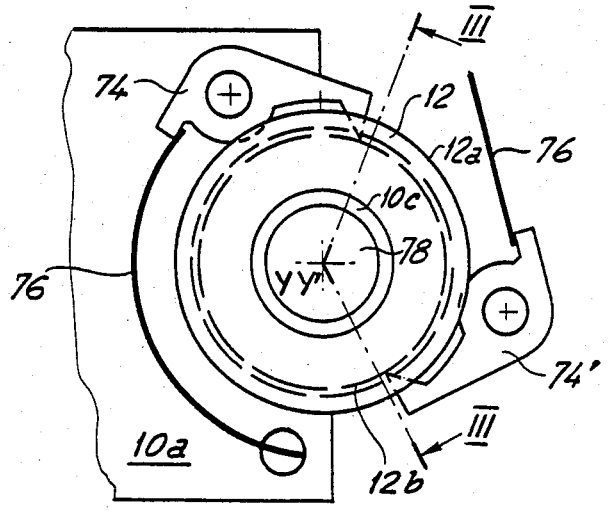
FIGS. 3*a* and 3*b* are respectively plan vertical sections of details of FIG. 1*a*, illustrating the pivotal mounting of the winding weight.
Figure 3B:
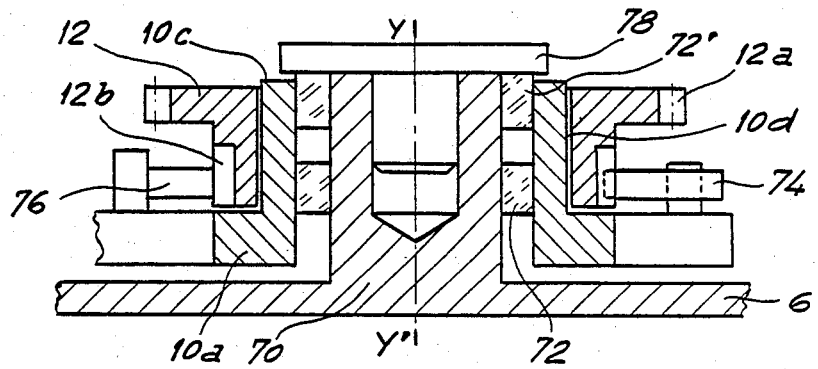
Figure 4:
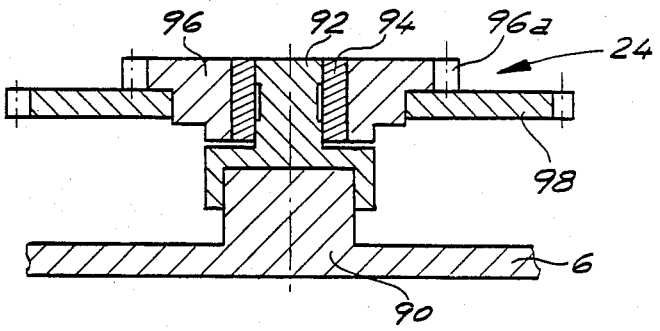
FIG. 4 is a partial vertical section on the line IV—IV of FIGS. 1*a* and 1*b* illustrating the mounting of the moving part which drives the minute hand.

FIGS. 2, 3, and 4 show in detail examples of the mounting of certain moving parts of the watch. FIGS. 3*a* and 3*b* show more particularly the mounting of the winding weight on its pivot pin. The pivot pin is constituted by a hollow projection 70 which forms an integral part of back plate 6. Around this projection are fitted two bearing bushes 72 and 72'. The arm 10*a* of the winding weight comprises a hollow sleeve 10*c* the axial bore of which is engaged over the bearing bushes 72 and 72'. The outer surface 10*d* of the sleeve 10*c* is finished so as to serve as the bearing for the ring 12 of the upper part of which is formed with a set of teeth 12*a* which mesh with the wheel 16. The ring 12 also has ratchet teeth 12*b* for engagement by two non-return pawls 74 and 74'. The pawl 74 is mounted for pivotal movement on the end of the arm 10*a*, while the pawl 74' is mounted on the back of the casing. These pawls are associated with return springs 76 and 76'. The arm 10*a* is maintained axially on its axis by means of headed stud 78 retained by a cotter pin (not shown) driven through the hollow projection 70.

When the winding weight pivots in a first direction, the pawl 74 is engaged with the ratchet teeth 12*b*, while the pawl 74' is disengaged. The arm causes the ring 12 to rotate and impart rotation to the ratchet wheel 14 of the spring barrel. When the winding weight 10 pivots in the other direction, the pawl 74' is in engagement with the ratchet teeth 12*b*, whereas the pawl 74 is disengaged. Thus, the winding weight no longer drives the ring 12, but the latter is held stationary by the pawl 74', thus preventing the ratchet wheel 14 of the spring barrel from rotating.

FIG. 2 similarly illustrates the mounting of the cannon wheel 28 and the center wheel 26. A projection 80 formed integrally with the back plate 6 has an axial bore 80*a* and its upper surface 80*b* is trued. In the bore 80*a* is mounted a pin 82. The center wheel 26, which carries the minute hand, is rotatably mounted on the pin 82. The cannon wheel 28, which carries the hour hand, is rotatably mounted on the center wheel 26 which has a radial bearing surface for the wheel 28. As for the center-wheel 26, it is supported on the trued surface 80*b* of the projection 80. The cannon wheel and the center wheel extend through a hole 42*d* in the dial 42 and into the display zone 44. As can be seen in this figure, the arm 10*a* has, in the region of the watch hands axis, its minimum thickness e which is less than the height of the projection 80. The are 10*a* thus passes beneath the wheels 26 and 28.

FIG. 4 shows an example of the mounting of the wheel 24 which drives the hand-carrying wheels. A projection 90 which is formed integrally with the back of the case serves as the supporting base for a pin 92. On this pin is mounted a plain bearing 94, for example of ruby. On this bearing is rotatably mounted a pinion 96 having teeth 96*a*. On the body of the pinion 96 is engaged as a force fit a wheel 98. An overhung mounting of the moving part is thus obtained. Similar mountings could be used for the wheel 22.

FIGS. 1*a* and 1*b* show that the wheels 32 to 38 of the final gear train, including the escapement wheel 38 are mounted between a lower bridge plate 100 and an upper bridge plate 102 interconnected by two sets of screwed pillars 101, 101' and 103, 103'. Likewise, the balance wheel 30 with its spiral spring is mounted between the back plate 6 and an escapement bridge plate 104 which is rigidly mounted on the base by means of an assembly of screwed pillars 105, 105' and locating pins 106, 106'. As for the spring barrel 20 and the moving parts 16 and 18, they are rotatably mounted between the back plate 6 and the external portion of the dial.

The watch obviously has a time-setting means, and if desired a manual winding means but these are not described as they do not form part of the present invention.

It follows from the preceding description that the invention enables a very thin, self-winding watch to be provided by a well thought out apportionment of the region of the case occupied by the oscillating mass and the region occupied by the other bulky elements. In addition, by using the back of the case as one of the plates of the movement, the overall thickness of the watch can be reduced. Finally, by recessing the time indicating means into the movement, the total thickness of the watch is still further reduced. For example, the thickness measured between the front surface of the glass and the rear surface of the back plate may be less than 2 mm., while at the same time acceptable values are maintained for the other dimensions of the watch.

It must be appreciated that the thickness of the watch casing is imposed by the thickness of the spring barrel. The winding weight (i.e., the oscillating mass and the arm) does not increase the thickness of the casing. By way of example, one such watch has been made with the following characteristics:

The weight of the oscillating mass is 2.75 g and its radious of gyration amounts to 14.65 mm. The resulting moment of inertia is 40.29 g.mm$^2$. The spring barrel develops a force of 200 g per mm. The balance wheel has a moment of inertia of between 2 and 2.5 g.cm$^2$. The ratio of the forces developed by the winding mechanism and the spring barrel is between 20:1 and 27:1. The result is a watch having good automatic functioning and a constant power which is sufficient to permit good regulation.

It is apparent that modifications and changes may be made in the operation and structure of the invention as described above without departing from the scope of the invention. The description has been made only by way of example, and is not to be taken as limiting the invention.

What is claimed is:

1. A self-winding watch comprising a case with a back and, within said case:

a first zone including analogue time indicating means rotating about a first axis perpendicular to the back; and a second zone at least partially located between said first zone and said back and including in a first region, a spring barrel having a thickness defined by spaced apart planes substantially parallel to the case back, an escapement-balance wheel unit, a gear train drivably interconnecing said spring barrel, said time indicating means and said escapement-balance wheel unit, and an arm located in said second zone and between the planes defining the thickness of the spring barrel, said arm having a longitudinal axis and first and second ends, said first end being pivotally mounted about a second axis perpendicular to the back, which is offset with respect to the first axis, and in a second region, an oscillating mass which is fixed to the second end of said arm to form therewith a winding weight for driving said spring barrel;

said mass and said spring barrel being located at the same level relative to the back; and said first axis being closer to the mass than said second axis.

2. The watch of claim 1, wherein each of said first and second regions represents substantially the half of said second zone.

3. The watch of claim 1, wherein said mass is located substantially wholly on the same side of the longitudinal axis of the arm.

4. The watch of claim 1, wherein said first zone is dish-shaped and partially surrounded by said second zone.

5. The watch of claim 4, wherein said spring barrel and said escapement balance wheel unit are located in the portion of said second zone which surrounds the first zone.

6. The watch of claim 4, wherein said mass is partially located in the portion of said second zone which surrounds the first zone.

7. The watch of claim 1, further comprising two deformable elements fixed to the case to form abutments for said mass.

* * * * *